US011162048B2

(12) United States Patent
Hanthorn et al.

(10) Patent No.: US 11,162,048 B2
(45) Date of Patent: Nov. 2, 2021

(54) LUBRICATING COMPOSITION WITH ALKYLATED NAPHTHYLAMINE

(71) Applicant: THE LUBRIZOL CORPORATION, Wickliffe, OH (US)

(72) Inventors: Jason J. Hanthorn, Wickliffe, OH (US); Yanshi Zhang, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/468,774

(22) PCT Filed: Dec. 13, 2017

(86) PCT No.: PCT/US2017/066088

§ 371 (c)(1),
(2) Date: Jun. 12, 2019

(87) PCT Pub. No.: WO2018/125567

PCT Pub. Date: Jul. 5, 2018

(65) Prior Publication Data

US 2019/0316056 A1 Oct. 17, 2019

Related U.S. Application Data

(60) Provisional application No. 62/439,231, filed on Dec. 27, 2016.

(51) Int. Cl.

| | |
|---|---|
| ***C10M 133/12*** | (2006.01) |
| ***C10M 141/06*** | (2006.01) |
| *C10N 10/04* | (2006.01) |
| *C10N 30/04* | (2006.01) |
| *C10N 30/10* | (2006.01) |
| *C10N 30/00* | (2006.01) |
| *C10N 40/25* | (2006.01) |

(52) U.S. Cl.

CPC ..... *C10M 133/12* (2013.01); *C10M 141/06* (2013.01); *C10M 2207/026* (2013.01); *C10M 2215/065* (2013.01); *C10M 2219/022* (2013.01); *C10M 2219/046* (2013.01); *C10M 2223/045* (2013.01); *C10N 2010/04* (2013.01); *C10N 2030/04* (2013.01); *C10N 2030/10* (2013.01); *C10N 2030/36* (2020.05); *C10N 2030/42* (2020.05); *C10N 2030/52* (2020.05); *C10N 2040/25* (2013.01)

(58) Field of Classification Search

CPC ..... C10M 133/12; C10M 141/06; C10M 2207/026; C10M 2215/065; C10M 2219/022; C10M 2219/046; C10M 2223/045

See application file for complete search history.

(56) References Cited

U.S. PATENT DOCUMENTS

| | | | | |
|---|---|---|---|---|
| 2,943,112 | A | 6/1960 | Popoff et al. | |
| 3,011,976 | A | 12/1961 | Cyba et al. | |
| 3,110,671 | A | 11/1963 | Cyba | |
| 3,172,892 | A | 3/1965 | Le Suer et al. | |
| 3,197,405 | A | 7/1965 | Le Suer | |
| 3,217,040 | A | 11/1965 | Schmerling | |
| 3,219,666 | A | 11/1965 | Norman et al. | |
| 3,230,257 | A | 1/1966 | Schmerling | |
| 3,316,177 | A | 4/1967 | Dorer, Jr. | |
| 3,340,281 | A | 9/1967 | Brannen, Jr. | |
| 3,351,552 | A | 11/1967 | Le Suer | |
| 3,381,022 | A | 4/1968 | Le Suer | |
| RE26,433 | E | 8/1968 | Le Suer | |
| 3,433,744 | A | 3/1969 | Le Suer | |
| 3,444,170 | A | 5/1969 | Norman et al. | |
| 3,467,668 | A | 9/1969 | Gruber et al. | |
| 3,501,405 | A | 3/1970 | Willette | |
| 3,542,680 | A | 11/1970 | Le Suer | |
| 3,576,743 | A | 4/1971 | Widmer | |
| 3,632,511 | A | 1/1972 | Liao | |
| 3,779,923 | A | 12/1973 | Gardiner | |
| 4,234,435 | A | 11/1980 | Meinhardt et al. | |
| 4,370,246 | A | 1/1983 | DeVries et al. | |
| 4,824,601 | A | 4/1989 | Franklin | |
| 4,863,623 | A | 9/1989 | Nalesnik | |
| 5,159,115 | A | 10/1992 | Pappas et al. | |
| 5,264,140 | A | 11/1993 | Mishra et al. | |
| 5,409,623 | A | 4/1995 | Mishra et al. | |
| 5,672,752 | A | 9/1997 | Lai et al. | |
| 5,965,495 | A * | 10/1999 | Goto | C10M 129/76 508/192 |
| 6,107,257 | A | 8/2000 | Valcho et al. | |
| 6,107,258 | A | 8/2000 | Esche, Jr. et al. | |
| 6,117,825 | A | 9/2000 | Liu et al. | |
| 6,153,565 | A | 11/2000 | Skinner et al. | |
| 6,165,235 | A | 12/2000 | Kolp et al. | |
| 6,204,412 | B1 | 3/2001 | Lai | |

(Continued)

FOREIGN PATENT DOCUMENTS

| | | |
|---|---|---|
| CN | 1981020 A1 | 6/2007 |
| EP | 0355895 A1 | 2/1990 |

(Continued)

*Primary Examiner* — Ellen M McAvoy

(74) *Attorney, Agent, or Firm* — Ann M. Skerry—Fay Sharpe; Vincent Cortese; Teresan Gilbert

(57) ABSTRACT

A lubricating composition includes an oil of lubricating viscosity, an N-alkyl naphthylamine, and at least one ashless antioxidant selected from a diarylamine antioxidant, a phenolic antioxidant, and mixtures thereof. The lubricating composition has a phosphorus content of less than 0.15 weight percent. The combination of the N-alkyl naphthylamine and ashless antioxidant provides a beneficial effect on the basicity of the composition without negatively impacting seals performance.

18 Claims, No Drawings

(56) References Cited

U.S. PATENT DOCUMENTS 6,281,179 B1 8/2001 Skinner et al.
6,315,925 B1 11/2001 Aebli et al.
6,326,336 B1 * 12/2001 Gatto ..... C10M 129/10 508/290
6,329,327 B1 12/2001 Tanaka et al.
6,355,839 B1 3/2002 Onopchenko
6,429,178 B1 8/2002 Skinner et al.
6,429,179 B1 8/2002 Skinner et al.
6,914,037 B2 7/2005 Gatto
7,238,650 B2 7/2007 Calder et al.
7,727,943 B2 6/2010 Brown et al.
8,242,066 B2 8/2012 Cheng et al.
8,288,328 B1 10/2012 Cheng et al.
2005/0198894 A1 9/2005 Migdal et al.
2006/0009366 A1 1/2006 Sant et al.
2006/0014651 A1 1/2006 Esche, Jr. et al.
2006/0079413 A1 4/2006 Kocsis et al.
2006/0183647 A1 8/2006 Kocsis et al.
2007/0129268 A1 * 6/2007 Bell ..... C10M 169/04 508/545
2008/0119378 A1 5/2008 Gandon et al.
2008/0280795 A1 11/2008 Fujitsu et al.
2009/0054278 A1 2/2009 Baumanis et al.
2009/0111720 A1 4/2009 Boffa
2009/0305923 A1 12/2009 Visger et al.
2010/0081592 A1 4/2010 Kocsis et al.
2010/0152079 A1 * 6/2010 Cherpeck ..... C10M 133/12 508/362
2010/0197536 A1 8/2010 Mosier et al.
2010/0269774 A1 10/2010 Shinoda et al.
2012/0103290 A1 5/2012 Startin et al.
2012/0132166 A1 * 5/2012 Andoh ..... C10M 169/04 123/1 A
2012/0178656 A1 7/2012 Sutton et al.
2012/0178659 A1 7/2012 Price et al.
2013/0252863 A1 * 9/2013 Cooper ..... C10M 141/08 508/273
2014/0171349 A1 * 6/2014 Ushioda ..... C10M 163/00 508/287
2014/0187458 A1 7/2014 Galic Raguz et al.
2015/0051126 A1 * 2/2015 Sato ..... C10M 169/04 508/258
2015/0203780 A1 7/2015 Yagishita
2015/0307803 A1 10/2015 Zhang
2016/0017252 A1 1/2016 Rowland
2017/0107439 A1 * 4/2017 Hutchison ..... C10M 111/04
2017/0362525 A1 * 12/2017 Foster ..... C10M 145/32
2019/0024008 A1 * 1/2019 Aoki ..... C10M 137/04

FOREIGN PATENT DOCUMENTS

EP 2206764 A1 7/2010
WO WO 2008/147704 12/2008
WO WO 2016/044262 3/2016

* cited by examiner

LUBRICATING COMPOSITION WITH ALKYLATED NAPHTHYLAMINE

This application claims the priority of International Application PCT/US2017/066088, filed Dec. 13, 2017, and U.S. Provisional Application No. 62/439,231, filed Dec. 27, 2016, from which the PCT application claims priority, the disclosures of which are incorporated herein by reference, in their entireties.

BACKGROUND

The exemplary embodiment relates to lubricating compositions and finds particular application in connection with lubricating compositions including an alkylated naphthylamine that is able to provide antioxidancy while boosting total base number (TBN) of the lubricating composition.

Ash-less additives (additives that produce little or no ash when burnt) are often used in engine oil formulations to provide performance properties, such as antioxidancy. Basic ashless additives, such as amines, may be used.

U.S. Pat. No. 8,288,328 to Cheng, et al., describes aniline compounds useful as ashless TBN sources for lubricating oil compositions that are said to be compatible with fluoroelastomeric engine seal materials, and lubricating oil compositions containing such aniline compounds.

In practice, however, many candidate additives tend to degrade the fluoroelastomer seals when contacted by the lubricating composition.

The basicity of additives employed in lubricating compositions suited to use as engine oils is often expressed as Total Base Number (TBN), as measured by ASTM D2896. This test method entails a titration that measures both strong and weak bases. TBN is expressed as an equivalent in milligrams of potash per gram of oil (mg of KOH/g). The titration uses chlorobenzene as a solvent.

Recently, there has been an interest in replacing chlorobenzene as a titration solvent. For example, the ISO 3771 test ("Petroleum products—Determination of base number—Perchloric acid potentiometric titration method"), uses glacial acetic acid as a titration solvent in TBN measurement. This method measures strong bases but does not readily titrate weak bases, such as some amines.

To meet standards that are based on ISO 3771, there remains a need for additives that provide good performance but which are also titrated under ISO 3771 better than conventional aminic antioxidants.

BRIEF DESCRIPTION

In accordance with one aspect of the exemplary embodiment, a lubricating composition includes an oil of lubricating viscosity, an N-alkyl naphthylamine compound, and at least one ashless antioxidant selected from a diarylamine antioxidant, a phenolic antioxidant, and combinations thereof. The lubricating composition has a phosphorus content of less than 0.15 weight percent.

In accordance with another aspect of the exemplary embodiment, a method for improving the retention of total base number in a crankcase lubricating composition comprising an oil of lubricating viscosity at least one ashless antioxidant selected from a diarylamine antioxidant, a phenolic antioxidant, and combinations thereof, the method comprising incorporating an N-alkyl naphthylamine in the lubricating composition, and wherein the lubricating composition has a phosphorus content of less than 0.15 weight percent.

DETAILED DESCRIPTION

Aspects of the exemplary embodiment relate to lubricating compositions containing one or more N-alkylated naphthylamines, and to methods of lubricating with such compositions. The N-alkylated naphthylamines can boost the total base number (TBN) of a lubricating composition, such as a passenger car engine oil composition, without compromising fluoroelastomer seals compatibility.

An exemplary lubricating composition includes an oil of lubricating viscosity, an N-alkyl naphthylamine, at least one ashless antioxidant (other than the N-alkyl naphthylamine(s) present), and optionally, one or more other performance additives. The phosphorus content of the lubricating composition may be less than 0.15 weight percent.

The N-alkyl naphthylamine may include one or two N-alkyl groups, i.e., the nitrogen group is mono- or di-substituted. In one embodiment, the nitrogen group is primarily mono-substituted. The N-alkyl group(s) may be acyclic, cyclic, or alicyclic. Acyclic alkyl groups may be branched or unbranched.

Each N-alkyl group may be a $C_1$-$C_{30}$ alkyl group, such as a $C_{24}$ or lower alkyl group, or a $C_{20}$ or lower, or a $C_{12}$ or lower, or a $C_{10}$ or lower alkyl group, or a $C_3$ or higher, or a $C_4$ or higher, or a $C_6$ or higher alkyl group.

Exemplary cyclic and alicyclic alkyl groups useful as N-alkyl groups include cyclopentyl and alkyl cyclopentyls, such as methylcyclopentyl, dimethylcyclopentyl, ethylcyclopentyl, and diethylcyclopentyl; cyclohexyl and alkylcyclohexyls, such as methylcyclohexyl, dimethylcyclohexyl, ethylcyclohexyl, methylethylcyclohexyl, and diethylcyclohexyl; cycloheptyl and alkylcycloheptyls, such as methylcycloheptyl, dimethylcycloheptyl, methylethylcycloheptyl, diethylcycloheptyl; cyclooctyl and alkylcyclooctyls, such as methylcyclooctyl and dimethylcyclooctyl, and combinations thereof.

Exemplary acyclic alkyl groups useful as N-alkyl groups include methyl, ethyl, propyl, butyl, pentyl, methylpentyl, hexyl, methyl hexyl, dimethylhexyl, ethylhexyl (e.g., 2-ethylhexyl), diethylhexyl, methylheptyl, dimethylheptyl, ethylheptyl, diethylheptyl, propylheptyl, octyl, isooctyl, nonyl, decyl, dodecyl, hexadecyl, eicosyl, hexacosyl, triacontyl, and combinations thereof.

In one embodiment, the N-alkyl naphthylamine is represented by the formula:

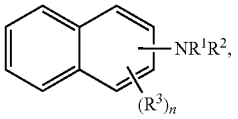

where $R^1$ is hydrogen or an alkyl group of 1 to 30 or 1 to 24 carbon atoms, $R^2$ is an alkyl group of 1 to 30 or 1 to 24 carbon atoms, $R^3$ is an alkyl group of 1 to 30 or 1 to 24 carbon atoms; and n is from 0-2, such as 0 or 1.

The N-alkyl naphthylamine may be an N-alkyl-1-naphthylamine or an N-alkyl-2-naphthylamine. Examples of N-alkyl naphthylamines wherein $R^3$ is present as an alkyl group include 1-methyl-2-naphthylamine, 3-methyl-2-naphthylamine, 2-methyl-1-naphthylamine, 3-methyl-1-naphthylamine, 1-ethyl-2-naphthylamine, 2-ethyl-1-naphthylamine, and mixtures thereof.

The N-alkyl-1-naphthylamine may be represented by the formula:

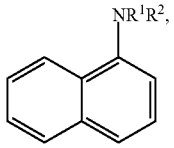

where $R^1$ and $R^2$ are defined as above. Optionally, one or more $R^3$ groups may be present, as described above.

The N-alkylated 1-naphthylamine may be represented by the formula:

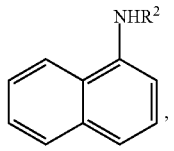

where $R^2$ is defined as above. For example, $R^2$ is an alkyl group of 6 to 24 carbon atoms. Optionally, one or more $R^3$ groups may be present, as described above.

In some embodiments, a mixture of N-alkyl naphthylamines may be used in the lubricating composition.

The N-alkyl naphthylamine may be at least 0.15 weight percent of the lubricating composition, such as at least 0.2 wt. %, or at least 0.3 wt. %, or at least 0.5 wt. %, or at least 0.8 wt. % of the lubricating composition. The N-alkyl naphthylamine may be up to 2.5 wt. % of the lubricating composition, or up to 2.0 wt. %, or up to 1.5 wt. % of the lubricating composition.

As used herein, TBN is measured according to one of ASTM D2896-15, "Standard Test Method for Base Number of Petroleum Products by Potentiometric Perchloric Acid Titration," ASTM International, West Conshohocken, Pa., 2015, referred to herein as TBN (ASTM D2896), and ISO 3771, 3rd Edition, Sep. 15, 2011, "Petroleum products—Determination of base number—Perchloric acid potentiometric titration method," International Organization for Standardization, referred to herein as TBN (ISO 3771).

TBN retention may be determined during nitration/oxidation testing. The oxidation/nitration test assesses the oxidation and nitration resistance of crankcase engine oil formulations. Oxidation of the components of the lubricating oil leads to an increase in the amount of C═O functionality present, while nitration of the components of the lubricating oil leads to an increase in various nitrogen-containing products represented by the structures $RONO_2$. In the test, nitric acid and iron naphthanoate are mixed into the lubricant prior to purging the sample with 50 cc/min of NOx gas, while heating for 22 hours in a 145° C. bath. The end of test sample is evaluated by FTIR for percent C═O increase (peak area at 1665-1820 $cm^1$) and $RONO_2$ (peak height at 1629+/−20 $cm^{-1}$). TBN retention is measured during the nitration and oxidation test as the difference between the TBN (e.g., ASTM D2896) at the start of test (SOT) and at the end of test (EOT).

Thin-film oxidative stability (antioxidancy performance) is measured according to the ACEA E5 oxidation bench test, CEC L-85-99, 4 Nov. 2014, "Hot Surface Oxidation—Pressure Differential Scanning calorimeter (PDSC)". In the test, 2 mg of a sample is heated to between 50° C. and 210° C., then held at that temperature for up to 2 hours in a closed system at 100 psi (~0.69 MPa) overpressure. The oxidative induction time, expressed in minutes, is the onset time (until the oil breaks and oxidation begins) observed from achieving the isothermal temperature. Higher values are thus better.

Unlike conventional aminic antioxidants, the TBN of the exemplary N-alkylated naphthylamines is detected under both ASTM D2896 and ISO 3771 test conditions. The alkylated naphthylamines are also capable of boosting thin-film antioxidancy performance and providing good TBN retention in nitration testing. The N-alkyl naphthylamine(s), when incorporated into a lubricating composition, can provide a lubricating composition which is less harmful towards seals, while having a TBN that meets industry standards for TBN (ISO 3771). The TBN retention of a lubricating composition containing an ashless antioxidant, such as a diarylamine antioxidant, can be improved by the exemplary N-alkyl naphthylamines.

Formation of the N-Alkyl Naphthylamine

The exemplary N-alkylated naphthalenes can be formed by reaction of an amino naphthalene, such as 1-aminonaphthylamine with an aldehyde or ketone, at a suitable reaction temperature, in an approximately 1:1 ratio (the aldehyde/ketone may be slightly in excess). An acidic alkylation catalyst may be employed, such as Lewis acids, trifluoromethanesulfonic acid, and acidic molecular sieves. Exemplary acid catalysts are aluminum chloride, boron trifluoride diethyl etherate, trifluoromethanesulfonic acid, and Amberlyst® molecular sieve-type catalysts. The product may be purified by redissolving it in a suitable solvent, such as methanol, and adding sodium borohydride. The resulting imine can be reduced by a suitable reducing agent, such as sodium borohydride or hydrogenation over a metal catalyst.

The aldehyde or ketone can be of the general formula:

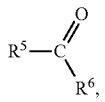

where

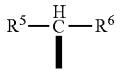

corresponds to $R^1$ and $R^2$ above, wherein at least one of $R^5$ and $R^6$ is not H.

In one embodiment, the aldehyde or ketone may be a $C_2$-$C_{12}$ aldehyde or ketone, such as a $C_2$-$C_9$ aldehyde, or a $C_2$-$C_6$ aldehyde or a $C_3$-$C_{10}$ ketone, or $C_3$-$C_7$ ketone.

Example ketones useful in forming the compound include methyl alkyl ketones and ethyl alkyl ketones of from 3-12 carbon atoms where the alkyl group may be alicyclic or cyclic. Examples of such ketones include those in which the alkyl portions are methyl, ethyl, propyl, butyl, pentyl, hexyl, heptyl, octyl, nonyl, decyl, cyclobutyl, cyclopentyl, cyclohexyl, cycloheptyl, cyclooctyl and as well as the various isomeric forms thereof. Examples of ketones include acetone, 2-butanone, 2-pentanone, 3-pentanone, 4-methyl-2-butanone, 2-hexanone, 4-methyl-2-hexanone, 4-heptanone, 5-methyl-2-hexanone, 5,6-dimethyl-2-hexanone, 5,5-dimethyl-2-hexanone, 4,5-dimethyl-2-hexanone, 4-ethyl-2-hexanone, 5-ethyl-2-hexanone, 4,5,5-trimethyl-2-hexanone, 2-heptanone, 3-heptanone, 5,5-dimethyl-2-heptanone, 4,5-dimethyl-2-heptanone, 5-ethyl-2-heptanone, 4-ethyl-2-heptanone, 2-octanone, 3-octanone, 4-octanone, 6-methyl-2-octanone, 7,7-dimethyl-2-octanone, 6-methyl-3-octanone, 6-ethyloctanone, 2-nonanone, 3-nonanone, 4-nonanone, 5-nonanone, 2-decanone, 3-decanone, 4-decanone, 5-decanone, cyclobutanone, cyclopentanone, cyclohexanone, methyl-cyclohexanones, ethyl-cyclohexanones, cycloheptanone, cyclooctanone, and the like.

The reaction can be carried out in a solvent, such as toluene.

An example method of preparation includes heating naphthylamine and the aldehyde/ketone under reflux in a ratio of about 1:1 in minimal toluene in the presence of a molecular sieve-type catalysts catalyst with removal of water. Once imine formation is complete, the catalyst can be removed by filtration and the toluene removed by distillation. A $C_1$-$C_6$ alcohol, such as methanol, is then added and the solution cooled to about room temperature (e.g., 10-20° C.). A reducing agent, such as sodium borohydride is added to reduce the imine. Once reduction is complete, the mixture is quenched by addition of water and the product may be extracted using a suitable organic solvent, such as toluene. Removal of solvent yields the product, which is includes, as a major amount,

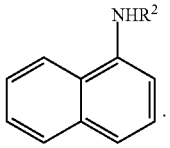

As will be appreciated, other methods for forming the N-alkyl naphthylamine are contemplated, such as those described in U.S. Pat. Nos. 3,217,040, 3,230,257, 5,159,115 and 8,288,328. U.S. Pat. No. 5,159,115 to Pappas, for example, describes catalyzed gas-phase mono N-alkylation of aromatic primary amines and aminonaphthalene using a $C_1$ to $C_5$ aliphatic alcohol or ether over a catalyst based upon crystalline molecular sieves or amorphous silica-aluminas. U.S. Pat. Nos. 3,217,040 and 3,230,257 to Schmerling, describe a process for the production of N-alkyl and N,N-dialkyl aromatic amines. The N-alkyl aromatic amines are prepared by condensing an alkylatable aromatic amine with an alkylamine in the presence of an iodine catalyst.

A lubricating composition may be prepared by adding the N-alkyl naphthylamine and ashless antioxidant to an oil of lubricating viscosity, optionally in the presence of other performance additives (as described herein below), or by adding reagents for forming the N-alkyl naphthylamine compound to an oil of lubricating viscosity. The lubricating composition may further include additional performance additives, such as antioxidants, additional dispersants, anti-wear agents, and friction modifiers. A method for forming a lubricating composition includes forming an N-alkyl naphthylamine compound and combining the N-alkyl naphthylamine compound with an oil of lubricating viscosity and at least one ashless antioxidant and optionally, one or more other performance additives, such as an overbased detergent, to provide a lubricating composition including no more than 0.15 weight percent of phosphorus, or no more than 0.11 weight percent, or no more than 0.08 weight percent phosphorus.

The Ashless Antioxidant

The lubricating composition may include one or more ashless antioxidant(s) (AAO) selected from a diarylamine antioxidant, a phenolic antioxidant, and a mixture thereof.

The AAO(s) may be present in the lubricating composition at a total concentration of at least 0.1 wt. %, such as at least 0.15 wt. %, or at least 0.2 wt. %, or at least 0.4 wt. %, or at least 0.6 wt. %, or up to 5 wt. %, or up to 3 wt. %, or up to 2 wt. %, or up to 1.5. wt. %, or up to 1.2 wt. %, or up to 1 wt. %. A weight ratio of the ashless antioxidant(s) to the N-alkyl naphthylamine(s) present in the lubricating composition may be at least 40:60 or up to 80:20, such as at least 50:50, or up to 70:30.

Exemplary diarylamine antioxidants useful herein include alkylated diphenylamine antioxidants, such as $C_1$-$C_{24}$ monoalkylated, dialkylated and polyalkylated diphenylamines, as described, for example, in U.S. Pat. Nos. 2,943,112; 4,824,601; 5,672,752; 6,204,412; 6,315,925; 6,355,839, and U.S. Pub. Nos. 2015/0307803 and 2016/0017252. Particularly useful are monoalkylated and dialkylated diphenylamines in which the alkyl group(s) include(s) at least 6 carbon atoms, such as at least 8, or at least 9 carbon atoms.

Examples of alkylated diphenylamines include those of the general formula:

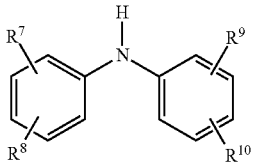

where each of $R^7$, $R^8$, $R^9$ and $R^{10}$, is selected from H and $C_8$-$C_{24}$ or $C_8$-$C_{12}$ alkyl groups, and wherein at least one of $R^7$, $R^8$, $R^9$, and $R^{10}$ is not H. In one embodiment, $R^8$ and $R^{10}$ (and optionally also $R^9$) are not H. Para-substitution by the alkyl group is common.

Example alkylated diphenylamines include dinonyl diphenylamine, nonyl diphenylamine, octyl diphenylamine, dioctyl diphenylamine, dodecyl diphenylamine, decyl diphenylamine, and mixtures thereof.

Methods for producing monoalkylated diphenylamines are described in U.S. Pat. No. 5,672,752. Methods for selectively producing p,p'-di-alkylated diphenylamines are described in U.S. Pub. No. 2016/0017252.

The alkylated diarylamine may also be an alkylated phenylnaphthylamine of the general form:

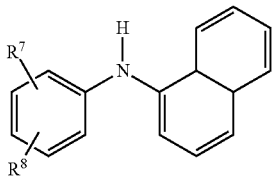

where each of $R^7$, $R^8$ are as defined above and at least one of $R^7$ and $R^8$ is not H.

Example alkylated diarylamines include octyl, dioctyl, nonyl, dinonyl, decyl and dodecyl phenylnaphthylamines, such as N-(Dodecylphenyl)naphthalen-1-amine.

Mixtures of alkylated diphenylamine and/or alkylated diarylamine antioxidants may be employed.

Exemplary phenolic antioxidants that may be used include $C_7$-$C_9$ branched alkyl esters of 3,5-bis(1,1-dimethylethyl)-4-hydroxy-benzenepropanoic acid, 2-tert-butylphenol, 2-tert-butyl-4-methylphenol, 2-tert-butyl-5-methylphenol, 2,4-di-tert-butylphenol, 2,4-dimethyl-6-tert-butylphenol, 2-tert-butyl-4-methoxyphenol, 3-tert-butyl-4-methoxyphenol, 2,5-di-tert-butylhydroquinone, 2,6-di-tert-butyl-4-alkylphenols such as 2,6-di-tert-butylphenol, 2,6-di-tert-butyl-4-methylphenol and 2,6-di-tert-butyl-4-ethylphenol, 2,6-di-tert-butyl-4-alkoxyphenols such as 2,6-di-tert-butyl-4-methoxyphenol and 2,6-di-tert-butyl-4-ethoxyphenol, 3,5-di-tert-butyl-4-hydroxybenzylmercaptooctylacetate, alkyl-3-(3,5-di-tert-butyl-4-hydroxyphenyl)propionates such as n-octadecyl-3-(3,5-di-tert-butyl-4-hydroxyphenyl)propionate, n-butyl-3-(3,5-di-tert-butyl-4-hydroxyphenyl)propionate and 2'-ethylhexyl-3-(3,5-di-tert-butyl-4-hydroxyphenyl)propionate, 2,6-di-tert-butyl-α-dimethylamino-p-cresol, 2,2'-methylene-bis(4-alkyl-6-cert-butylphenol) such as 2,2'-methylenebis(4-methyl-6-tert-butylphenol, and 2,2-methylenebis(4-ethyl-6-tert-butylphenol), bisphenols such as 4,4'-butylidenebis(3-methyl-6-tert-butylphenol, 4,4'-methylenebis(2,6-di-tert-butylphenol), 4,4'-bis(2,6-di-tert-butylphenol), 2,2-(di-p-hydroxyphenyl)propane, 2,2-bis(3,5-di-tert-butyl-4-hydroxyphenyl)propane, 4,4'-cyclohexylidenebis(2,6-tert-butylphenol), hexamethyleneglycol-bis[3-(3,5-di-tert-butyl-4-hydroxyphenyl)propionate], triethyleneglycolbis[3-(3-tert-butyl-4-hydroxy-5-methylphenyl)propionate], 2,2'-thio-[diethyl-3-(3,5-di-tert-butyl-4-hydroxyphenyl)propionate], 3,9-bis{1,1-dimethyl-2-[3-(3-tert-butyl-4-hydroxy-5-methyl-phenyl)propionyloxy]ethyl}2,4,8,10-tetraoxaspiro[5,5]undecane, 4,4'-thiobis(3-methyl-6-tert-butylphenol) and 2,2'-thiobis(4,6-di-tert-butylresorcinol), polyphenols such as tetrakis[methylene-3-(3,5-di-tert-butyl-4-hydroxyphenyl)propionate]methane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, bis-[3,3'-bis(4'-hydroxy-3'-tert-butylphenyl)butyric acid]glycol ester, 2-(3',5'-di-tert-butyl-4-hydroxyphenyl)methyl-4-(2",4"-di-tert-butyl-3"-hydroxyphenyl)methyl-6-tert-butylphenol and 2,6-bis(2'-hydroxy-3'-tert-butyl-5'-methylbenzyl)-4-methylphenol, and p-t-butylphenol-formaldehyde condensates and p-t-butylphenol-acetaldehyde condensates.

Phenol-based antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group.

Examples of particularly suitable hindered phenol antioxidants include 2,6-di-tert-butylphenol, 4,4'-methylenebis-(2,6-di-tert-butylphenol), 4-methyl-2,6-di-tert-butylphenol, 4-ethyl-2,6-di-cert-butylphenol, 4-propyl-2,6-di-tert-butylphenol, 4-butyl-2,6-di-tert-butylphenol, 4-dodecyl-2,6-di-tert-butylphenol, 2,2'-methylenebis(4-methyl-6-tert-butylphenol), 2,2'-methylenebis(4-ethyl-6-tert-butylphenol), as described, for example, in U.S. Pub. Nos. 2009/0111720, 2010/0269774, and 2012/0103290. In one embodiment, the hindered phenol antioxidant may be an ester, such as those described in U.S. Pat. No. 6,559,105, such as an alkyl alcohol esters of 3-(4-hydroxy-3,5-di-tert-butyl-phenyl)propionic acid. One such hindered phenol ester is sold as Irganox™ L-135, obtainable from Ciba.

Oil of Lubricating Viscosity

The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. %, or up to 98 wt. %, or up to 95 wt. %, of the lubricating composition.

The amount of the oil of lubricating viscosity present may be typically the balance remaining after subtracting from 100 wt. %, the sum of the amount of the antioxidants, as described above, and any other performance additives.

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/147704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. % saturates, viscosity index 80-120); Group II (sulfur content <0.03 wt. %, and >90 wt. % saturates, viscosity index 80-120); Group III (sulfur content <0.03 wt. %, and >90 wt. % saturates, viscosity index >120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The lubricating composition disclosed herein may have a SAE viscosity grade of XW-Y, wherein X may be 0, 5, 10 or 15; and Y may be 8, 12, 16, 20, 30 or 40.

The oil of lubricating viscosity may have a kinematic viscosity of up to 30 $mm^2/s$ or up to 25 $mm^2/s$ (cSt) at 100° C. and can be at least 4 $mm^2/s$ at 100° C., and in other embodiments at least 6 $mm^2/s$, or at least 6.5 $mm^2/s$, or at least 6.9 $mm^2/s$. As used herein, kinematic viscosity is determined at 100° C. by ASTM D445-15a, "Standard Test Method for Kinematic Viscosity of Transparent and Opaque Liquids (and Calculation of Dynamic Viscosity)," ASTM International, West Conshohocken, Pa., DOI: 10.1520/D0445-15a and may be referred to as KV_100.

The viscosity grade of the oil depends on the end use. For passenger car and diesel engines, the viscosity grade may be SAE OW-16, SAE OW-20, SAE 5W-20, SAE 5W-30, SAE 10W-30 or SAE 15W-40. The base oil may be a blend of two or more fractions having different oligomer distributions. A fraction rich in lower oligomers is typically blended with a fraction rich in higher oligomers to achieve the desired oligomer distribution. However, any combination of fractions which will yield a composite having the required distribution of oligomers is acceptable. The fractions employed for such blending may be different distillation cuts from the same process or may be obtained from entirely different oligomerization processes. A single fraction may be used to produce different multigrade oils, e.g. SAE 10W-30 and SAE 15W-40 oils. The composite obtained after blending can be hydrogenated or the individual fractions can be hydrogenated before they are blended.

For 2-stroke marine diesel engines the viscosity grade may be from SAE-40 to SAE-60, which corresponds to a KV_100 of 12.5 to 26 $mm^2/s$. SAE-50 grade oils, for example, have a KV_100 of 16.3-21.9 $mm^2/s$. Cylinder oils for 2-stroke marine diesel engines may be formulated to achieve a KV_100 of 19 to 21.5 $mm^2/s$. This viscosity can be obtained by a mixture of additives and base oils, for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

As an example, an oil formulation suited to use as a cylinder lubricant for low-speed 2-stroke marine diesel engines contains 18 to 25 wt. % of a Group I base oil of a BSS type (distillation residue, with a KV_100 of 28-32 $mm^2/s$, with a density at 15° C. of 895-915 $kg/m^3$), and 50 to 60 wt. % of a Group I base oil of a SN 600 type (distillate, with a density at 15° C. of 880-900 $kg/m^3$, with a KV_100 of about 12 $mm^2/s$).

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, polyacrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Synthetic ester base oils may be present in the lubricating composition in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rape oil, and soya oil.

The amount of the oil of lubricating viscosity present is typically the balance remaining after subtracting from 100 weight % the sum of the amount of the exemplary N-alkylated naphthylamine compound and the other performance additives.

The phosphorus content of the lubricating composition may be 0.15 wt % or less, or 0.11% wt % or less, or 0.08 wt. % or less, or 0.06 wt. % or less, or 0.05 wt. % or less. In one embodiment, the phosphorus content may be at least 100 ppm, such as 100 ppm to 1100 ppm, or 200 ppm to 800 ppm, or up to 600 ppm.

Other Performance Additives

In addition to the exemplary N-alkylated naphthylamine and ashless antioxidant compound(s) disclosed herein, the lubricating composition may further include one or more of the following additional performance additives: other antioxidants, dispersants, viscosity modifiers, antiwear/antiscuffing agents, metal deactivators, friction modifiers, extreme pressure agents, foam inhibitors, demulsifiers, pour point depressants, corrosion inhibitors, seal swelling agents, TBN boosters, and the like. The additional performance additive(s) may be suited to providing the performance properties of a fully formulated lubricating composition, e.g., a passenger car or HD engine lubricant.

A. Other Antioxidants

The lubricating composition optionally further includes at least one antioxidant, in addition to the AAOs listed above. Exemplary antioxidants useful herein include sulfurized olefins. Examples of suitable olefins that may be sulfurized to form the sulfurized olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene, and mixtures thereof. In one embodiment, hexadecene, heptadecene, octadecene, octadecenene, nonodecene, eicosene, mixtures thereof, and their dimers, trimers and tetramers, are especially useful olefins.

Alternatively, the olefin may be a Diels-Alder adduct of a diene such as 1,3-butadiene and an unsaturated ester, such as, butylacrylate. Another class of sulfurized olefin includes fatty acids and their esters. The fatty acids can be obtained from vegetable oil or animal oil; and may contain from 4 to 22 carbon atoms. The fatty acids may be obtained, for example, from lard oil, tall oil, peanut oil, soybean oil, cottonseed oil, sunflower seed oil, or mixtures thereof. Examples of suitable fatty acids and their esters include triglycerides, oleic acid, linoleic acid, palmitoleic acid, and mixtures thereof. In one embodiment, the fatty acid(s) and/or ester is/are mixed with one or more olefins.

When present, the lubricating composition may include at least 0.1 wt. % or at least 0.5 wt. %, or at least 1 wt. % of such antioxidant(s), and in some embodiments, up to 3 wt. %, or up to 2.75 wt. %, or up to 2.5 wt. %, or up to 1.2 wt. of such antioxidant.

B. Detergents

The lubricating composition optionally further includes at least one detergent. Exemplary detergents useful herein include overbased metal-containing detergents. The metal of the metal-containing detergent may be calcium, zinc, sodium, barium, or magnesium. In one embodiment, the lubricating composition includes an alkaline earth metal overbased detergent in an amount sufficient to deliver at least 2 mg KOH/g of total base number (TBN), as measured in accordance with ASTM D2896-15, to the lubricating composition.

The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Typically, an overbased metal-containing detergent may be a calcium, zinc, sodium, or magnesium salt of a sulfonate, a phenate, a sulfur containing phenate, a salixarate or a salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

The sulfonate detergent may be a metal salt of one or more oil-soluble alkyl toluene sulfonate compounds as disclosed in U.S. Pub. No. 20080119378.

In one embodiment, the lubricating composition may be free of linear alkylbenzene sulfonate detergent.

The lubricating composition may include at least 0.01 wt. % or at least 0.1 wt. %, detergent, and in some embodiments, up to 2 wt. %, or up to 1 wt. % detergent.

C. Dispersants

The lubricating composition optionally further includes at least one dispersant. Exemplary dispersants include succinimide dispersants, Mannich dispersants, succinamide dispersants, and polyolefin succinic acid esters, amides, and ester-amides, and mixtures thereof.

The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment, the dispersant may be a polyolefin succinic acid ester, amide, or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of at least 300, or at least 350, or at least 500, or at least 550, or at least 750, and can be up to 5000, or up to 3000, or up to 2500. Such succinimides can be formed, for example, from high vinylidene polyisobutylene and maleic anhydride. Succinimide dispersants and their preparation are disclosed, for example, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, and 7,238,650 and EP Patent Application 0 355 895 A.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

Dispersant viscosity modifiers (DVM) are dispersants which provide both dispersancy and viscosity modification. Example DVMs are made from polymers such as an olefin polymer (e.g., ethylene propylene copolymer) and/or vinyl aromatic polymers (e.g., polystyrene) that have been radically grafted with an ethylenically unsaturated carboxylic acid material, such as maleic anhydride which is functionalized with one or more amines and/or a pendent functional group which has sulfonate functionality. DVMs of this type are disclosed, for example, in U.S. Pat. Nos. 4,863,623; 5,264,140; 5,409,623; 6,107,257; 6,107,258; 6,117,825; U.S. Pub. Nos. 2012/0178656; 2012/0178659; 2009/0305923, and WO 2016044262.

When present, the lubricating composition may include at least 0.01 wt. %, or at least 0.1 wt. %, or at least 0.5 wt. %, or at least 1 wt. % dispersant, and in some embodiments, up to 20 wt. %, or up to 15 wt. %, or up to 10 wt. %, or up to 6 wt. % or up to 3 wt. % dispersant.

D. Anti-Wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates (ZDDPs)), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl)disulfides. The antiwear agent may in one embodiment include a tartrate or tartrimide, as described in U.S. Pub. Nos.

2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as disclosed in US Pub. No. 20050198894.

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

In one embodiment, the lubricating composition is free or substantially free of phosphorus-containing antiwear agents. For example phosphorus-containing antiwear agents are present, if at all, in an amount which enables the lubricating composition to have no more than 0.11 wt. % phosphorus, or up to 0.03 wt. % phosphorus. For example, C6 and/or C3/6 mixed secondary ZDDP's may be present at a total concentration of up to 1.2 wt. %.

E. Oil Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV)alkoxides, such as titanium (IV) isopropoxide and titanium (IV) 2-ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid mono-esters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent.

F. Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyl disulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as di-hydrocarbon and tri-hydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt. %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

G. Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

H. Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMAs are prepared from mixtures of methacrylate monomers having different alkyl groups. The alkyl groups may be either straight chain or branched chain groups containing from 1 to 18 carbon atoms. Most PMAs are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

I. Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

J. Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

K. Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically not produce any sulfated ash when subjected to the conditions of ASTM D 874 (see ASTM D874-13a, "Standard Test Method for Sulfated Ash from Lubricating Oils and Additives," ASTM International, West Conshohocken, Pa., 2013). An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

The amount of the ash-free friction modifier in a lubricant may be 0.1 to 3 wt. % (or 0.12 to 1.2 or 0.15 to 0.8 wt. %). The material may also be present in a concentrate, alone or with other additives and with a lesser amount of oil. In a concentrate, the amount of material may be two to ten times the above concentration amounts.

In one embodiment, the ash-free friction modifier may be represented by the formula:

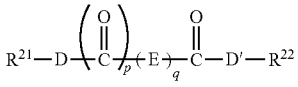

where D and D' are independently selected from —O—, >NH, >$NR^{23}$, an imide group formed by taking together both D and D" groups and forming a $R^{21}$—N< group between two >C═O groups; E is selected from $R^{24}$—O—$R^{25}$—, >$CH_2$, >$CHR^{26}$, >$CR^{26}R^{27}$, >C(OH)($CO_2R^{22}$), >$C(CO_2R^{22})^2$, and >$CHOR^{28}$; where $R^{24}$ and $R^{25}$ are independently selected from >$CH_2$, >$CHR^{26}$, >$CR^{26}R^{27}$, >C(OH)($CO_2R^{22}$), and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$) tartrate, di($C_{12-15}$) tartrate, dioleyl tartrate, oleyl tartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a monoester and in another embodiment the long chain fatty acid ester may be a triglyceride.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula:

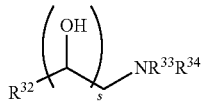

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl)amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-cocoyl methylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, bis(2-hexyldecyl)amine, bis(2-octyldodecyl)amine, bis(2-decyltetradecyl)amine, beef tallow dialkylamine, hardened beef tallow dialkylamine, and soybean oil dialkylamine; and trialk(en)ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal, such as sodium or potassium, ammonium molybdates {$(NH_4)_2MoO_4$ or heptamolybdate $(NH_4)_6[Mo_7O_{24}].4H_2O\}$, $MoOCl_4$, $MoO_2Cl_2$, $MoO_2Br_2$, $Mo_2O_3Cl_6$, and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other suitable organomolybdenum compounds may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaminopropylamine, dodecylaminoethylamine, hexadecylaminopropylamine, hexadecylaminoethylamine, octadecyl-aminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube® 710 available from Adeka which is a molybdenum amine compound, and Molyvan® 855, available from R. T. Vanderbilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

L. Demulsifiers

Demulsifiers useful herein include trialkyl phosphates, and various polymers and copolymers of ethylene glycol, ethylene oxide, propylene oxide, and mixtures thereof.

M. Seal Swell Agents

Seal swell agents useful herein include sulfolene derivatives such as Exxon Necton-37™ (FN 1380) and Exxon Mineral Seal Oil™ (FN 3200).

N. TBN Boosters

Useful TBN boosters, other than the exemplary N-alkyl naphthylamine; and ashless antioxidant, are anthranilate ester (esters of anthranilic acid) as described, for example, in U.S. Pub. No. 20140187458, such as decyl anthranilate.

Example Lubricating Compositions

An engine lubricant in different embodiments may have a composition as illustrated in Table 1. All additives are expressed on an oil-free basis.

TABLE 1

Example Lubricating Composition

| Additive | Embodiments (wt. %) A | B | C |
|---|---|---|---|
| N-alkyl naphthylamine | 0.1 to 5 | 0.2 to 2.5 | 0.3 to 1 |
| Ashless antioxidant selected from a diarylamine antioxidant and a phenolic antioxidant | 0.0 to 5 | 0.1 to 2.5 | 0.3 to 1 |
| Overbased Detergent(s) | 0.1 to 8 | 0.3 to 6 | 1 to 5 |
| Dispersant Viscosity Modifier | 0 to 5 | 0.05 to 4 | 0.1 to 2 |
| Dispersants | 0 to 12 | 1.5 to 8 | 0.5 to 6 |
| Other Antioxidants | 0.0 to 13 | 0.1 to 10 | 2.0 to 5 |
| Other Detergents | 0.1 to 8 | 0.3 to 6 | 1 to 5 |
| Antiwear Agent | 0.1 to 10 | 0.1 to 5 | 0.3 to 2 |
| Friction Modifier | 0.01 to 4 | 0.05 to 2 | 0.1 to 1 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Use of the Lubricating Composition

The lubricating composition described herein may be used in a method for reducing seals degradation in an internal combustion engine. The internal combustion engine is lubricated with the lubricating composition.

The end use of the lubricating composition described herein includes use as a cylinder lubricant for an internal combustion engine, such as in a passenger car or a heavy, medium, or light duty diesel vehicle, but may also find use as an engine oil for 2-stroke marine diesel engines, small engines such as motorcycle and 2-stroke oil engines, as a driveline lubricant, including gear and automatic transmission oils, and for other industrial oils, such as hydraulic lubricants.

An exemplary method of lubricating a mechanical device, such as a passenger car engine cylinder, includes supplying the exemplary lubricating composition to the device.

Generally, the lubricating composition is added to the lubricating system of an internal combustion engine, which then delivers the lubricating composition to the cylinder of the engine, during its operation.

The internal combustion engine may be a gasoline fuelled engine, a diesel-fuelled engine, such as a 2-stroke marine diesel engine, or a natural gas fuelled engine, a mixed gasoline/alcohol fuelled engine, or a biodiesel fuelled engine. The internal combustion engine may be a 2-stroke or 4-stroke engine.

In one embodiment, the disclosed technology provides a method of lubricating a 2-stroke or 4-stroke internal combustion engine comprising supplying to the internal combustion engine a lubricating composition as disclosed herein.

In one specific embodiment, a method for improving the retention of total base number in a crankcase lubricant includes lubricating the crankcase with a lubricating composition as described above.

The internal combustion engine may be a passenger car internal combustion engine. The passenger car internal combustion engine may have a reference mass not exceeding 2610 kg. The passenger car engine may be operated on unleaded gasoline. Unleaded gasoline is well known in the art and is defined by British Standard BS EN 228:2008

(entitled "Automotive Fuels—Unleaded Petrol—Requirements and Test Methods"). The internal combustion engine may also be a heavy duty diesel internal combustion engine. The heavy duty diesel internal combustion engine may have a "technically permissible maximum laden mass" over 3,500 kg. The engine may be a compression ignition engine or a positive ignition natural gas (NG) or LPG (liquefied petroleum gas) engine.

The lubricating composition may be suitable for use as a cylinder lubricant irrespective of the sulfur, phosphorus or sulfated ash (ASTM D-874) content of the fuel. The sulfur content of the lubricating composition, which is particularly suited to use as an engine oil lubricant, may be 1 wt. % or less, or 0.8 wt. % or less, or 0.5 wt. % or less, or 0.3 wt. % or less. In one embodiment, the sulfur content may be in the range of 0.001 wt. % to 0.5 wt. %, or 0.01 wt. % to 0.3 wt. %. The total sulfated ash content may be 2 wt. % or less, or 1.5 wt. % or less, or 1.1 wt. % or less, or 1 wt. % or less, or 0.8 wt. % or less, or 0.5 wt. % or less, or 0.4 wt. % or less. In one embodiment, the sulfated ash content may be 0.05 wt. % to 0.9 wt. %, or 0.1 wt. % to 0.2 wt. % or to 0.45 wt. %.

Without intending to limit the scope of the exemplary embodiment, the following examples illustrate preparation and evaluation of example compounds.

EXAMPLES

All reactants and additives are expressed on an oil-free basis.

Example 1: Preparation of N-ethylhexyl-1-naphthylamine

Naphthylamine (1 eq.) and 2-ethylhexanal (1.03 eq.) are heated to reflux in minimal toluene in the presence of Amberlyst™ 15 catalyst (5 wt. % with respect to naphthylamine) with removal of water. Once imine formation is complete, the catalyst is removed by filtration and the toluene removed by distillation. Methanol is then charged to the flask and the solution cooled using an ice bath. Sodium borohydride (1 eq.) is added portion-wise. Once reduction is complete, the mixture is quenched by addition of water and the product extracted using toluene. Removal of the solvent yields the product.

Example 2: Preparation of N-methylcyclohexyl-1-naphthylamine

The method of example 1 was repeated, using methylcyclohexanone (1.03 eq.) in place of 2-ethylhexanal.

The basicity of the N-alkyl-1-naphthylamines of Examples 1 and 2 is determined according to TBN (ASTM D2896), TBN (ISO 3771) and ASTM D4739-11, "Standard Test Method for Base Number Determination by Potentiometric Hydrochloric Acid Titration," ASTM International, West Conshohocken, Pa., 2011. The results are shown in Table 2.

TABLE 2

TBN titrations of alkyl naphthylamines

| Example | Aldehyde/Ketone | D2896 | ISO 3371 | D4739 |
|---|---|---|---|---|
| 1 | 2-ethylhexanal | 215 | 226 | 17.8 |
| 2 | 4-methylcyclohexanone | 241 | 235 | 19.7 |

Examples 3-5: Preparation of Lubricating Compositions

The N-alkyl-1-naphthylamines of Examples 1 and 2 are evaluated by incorporating them into lubricating formulations.

Example 3 includes N-ethylhexyl-1-naphthylamine and an alkylated diphenyl amine in a weight ratio of 1:2.5. Example 4 includes N-methylcyclohexyl-1-naphthylamine and an alkylated diphenyl amine in a weight ratio of 1:2.5. Example 5 is a comparative example without N-alkyl naphthylamine.

Table 3 shows the components of the three lubricating compositions, expressed in weight %, on an oil-free (i.e., active) basis.

TABLE 3

Lubricating compositions

| Component | Example 3 | Example 4 | Comp Example 5 |
|---|---|---|---|
| Group II Base Oil | Balance to 100% | Balance to 100% | Balance to 100% |
| Alkyl Naphthylamine of Ex. 1 | 0.5 | | |
| Alkyl Naphthylamine of Ex. 2 | | 0.5 | |
| Overbased detergent (Ca alkylsulfonates) | 1.1 | 1.1 | 1.1 |
| Zinc dialkyldithiophosphate | 0.86 | 0.86 | 0.86 |
| Antioxidant (alkylated diphenyl amine = nonylated diphenylamine) | 1.2 | 1.2 | 1.2 |
| Antioxidant (hindered phenol ester = 3,5-dibutyl-4-hydroxyphenyl) propanoate ester) | 0.53 | 0.53 | 0.53 |
| Active Dispersant (2000 $M_n$ polyisobutylene succinimide) | 2.92 | 2.92 | 2.92 |
| Viscosity Modifier | 0.72 | 0.72 | 0.72 |
| Additional additives | 0.45 | 0.45 | 0.45 |
| % Phosphorus | 0.075 | 0.075 | 0.075 |

The additional additives include friction modifiers, foam inhibitors, corrosion inhibitors, etc.

The impact of the compositions on antioxidancy performance (thin-film, deposits, nitration, etc.) as well as their impact on fluoroelastomer seals was evaluated. Table 4 shows the results obtained for the following tests:

1. Antioxidancy and Deposit-Forming Tendencies

Thin film antioxidancy is measured as Oxidation Induction Time (OIT) in minutes (L-85-99), which represented the time after which oxygen uptake, as measured by a pressure drop, ceases. The longer the OIT the superior the antioxidancy.

The lubricants are also tested for oxidative stability through a modified pressurized differential scanning calorimetry (PDSC) measurement. This test measures the time at which significant oxidation commences. The test uses about 3 mg of sample and 3.5 MPa (500 psi) oxygen under a flow of 30 mL/min, starting at 40° C., increasing to an elevated holding temperature.

Deposit values, in mg, are used to assess deposit-forming tendencies, and are determined according to ASTM D7097-16a, "Standard Test Method for Determination of Moderately High Temperature Piston Deposits by Thermo-Oxidation Engine Oil Simulation Test—TEOST MHT," ASTM International, West Conshohocken, Pa., 2016.

Nitration/oxidation testing, as described above, is used to measure C═O Area (absorbance/cm) and $RONO_2$ Height (absorbance/cm). During the test, the initial and final TBN (TBN INIT, TBN EOT) are determined according to ASTM D2896 in mg KOH/g.

2. Seals Performance

The impact on fluoroelastomer rubber (FKM) seals is measured by the DBL6674_FKM Mercedes-Benz fluoroelastomer seals bench test. This test probes changes in seals hardness, tensile strength, and rupture elongation parameters after immersion in the formulation at 150° C. for 168 hours.

TABLE 4

| Performance Tests | | | |
|---|---|---|---|
| Lubricating composition | EXAMPLE 3 (0.5% Ex. 1) | EXAMPLE 4 (0.5% Ex. 2) | COMP. EX. 5 |
| TBN, mg KOH/g (ISO 3771) | 9.7 | 9.5 | 8.2 |
| OXIDATION AND DEPOSIT FORMING TENDENCIES | | | |
| Deposits, mg (D7097) | 17.6 | 15.9 | 15.5 |
| OIT, minutes (L-85-99) | 111.9 | 134.7 | 105.9 |
| PDSC (Onset time, min) | 112 | 128 | 81.4 |
| NITRATION/OXIDATION TESTING | | | |
| C═O AREA, absorbance/cm | 14 | 13.2 | 13.2 |
| $RONO_2$ HEIGHT, absorbance/cm | 17.8 | 16.2 | 21.8 |
| TBN INIT, mg KOH/g (D2896) | 9.7 | 9.5 | 8.2 |
| TBN EOT, mg KOH/g (D2896) | 3.7 | 3.8 | 3.3 |
| D2896_CHANGE mg KOH/g | | | |
| FKM SEALS PERFORMANCE | | | |
| HARDNESS CHANGE PTS | −2 | −2 | −2 |
| T/S CHANGE, % | −22.5 | −12.8 | −5.8 |
| R/E CHANGE, % | −20.1 | −10.1 | −24.8 |
| SEALS ASSESSMENT | PASS | PASS | PASS |

Both naphthylamines provide a boost in thin-film antioxidancy testing, with the 4-methylcyclohexyl naphthalene in Ex. 4 delivering a significant increase in both L-85-99 and PDSC over the baseline. The impact on deposit testing is slightly negative in both cases, although the 4-methylcyclohexyl naphthalene again performs better.

In nitration testing, both alkyl naphthalenes significantly reduce the total nitration content while delivering both increased start-of-test and end-of-test TBN (D2896).

Seals testing is better for the 4-methylcyclohexyl naphthalene than for the 2-ethylhexyl naphthalene, but both comfortably pass the test. Although both components have a negative impact on tensile strength, they have a positive impact on rupture elongation.

Examples 6 and 7: Lubricating Compositions

N-(4-methylcyclohexyl)naphthylamine was tested in an formulation as a replacement for the alkylated diphenyl amine antioxidant. Table 5 shows the shows the components of the lubricating compositions, expressed in weight %, on an oil-free (i.e., active) basis.

TABLE 5

| Lubricating compositions | | |
|---|---|---|
| Component | Comp. EXAMPLE 6 | EXAMPLE 7 |
| Group II Base Oil | Balance to 100% | Balance to 100% |

TABLE 5-continued

| Lubricating compositions | | |
|---|---|---|
| Component | Comp. EXAMPLE 6 | EXAMPLE 7 |
| alkyl naphthylamine of Ex. 2 (methylcyclohexyl-1-naphthylamine) | — | 0.8 |
| Overbased detergent (mixture of Ca alkylsulfonates and Ca alkylphenates) | 1.21 | 1.21 |
| Zinc dialkyldithiophosphate | 0.85 | 0.85 |
| Phenolic antioxidant (hindered phenol ester) | 1.0 | 1.0 |
| Aminic Antioxidant | 0.8 | — |
| Antioxidant-sulfurized olefin | 0.1 | 0.1 |
| Active Dispersant (2000 Mn polyisobutylene succinimide dispersant) | 3.55 | 3.55 |
| Viscosity Modifier | 1.47 | 1.47 |
| Additional additives | 0.45 | 0.45 |
| % Phosphorus | 0.075 | 0.075 |

The additional additives include friction modifiers, foam inhibitors. etc. Performance results are shown in TABLE 6.

TABLE 6

| Performance Tests | | |
|---|---|---|
| | EXAMPLE 6 (No Ex. 2) | EXAMPLE 7 (with Ex. 2) |
| TBN, mg KOH/g (ISO 3771) | 5.6 | 7.5 |
| TBN, mg KOH/g (ASTM D4739) | 5.49 | 5.53 |
| OXIDATION AND DEPOSITS | | |
| Deposits, mg (D7097) | | |
| OIT, minutes (L-85-99) | 104.1 | 78.1 |
| PDSC (Onset time, min) | 70.9 | 78.9 |
| C═O AREA, absorbance/cm | 12.9 | 13.4 |
| $RONO_2$ HEIGHT, absorbance/cm | 19.9 | 14.5 |
| TBN INIT, mg KOH/g (D2896) | 6.8 | 7.5 |
| TBN EOT, mg KOH/g (D2896) | 3.1 | 3.7 |
| TBN CHANGE mg KOH/g (D2896) | 3.7 | 3.8 |
| TBN INIT, mg KOH/g (D4739) | 5.7 | 5.7 |
| TBN EOT, mg KOH/g (D4739) | 1.2 | 1.8 |
| FKM SEALS PERFORMANCE | | |
| HARDNESS CHANGE PTS | −2 | −2 |
| T/S CHANGE, % | −3.8 | −5.4 |
| R/E CHANGE, % | −1.1 | −10.1 |

The Example 7 formulation containing the methylcyclohexyl naphthylamine (Ex. 2) titrates ISO 3771 at 1.9 TBN higher than the Example 6 baseline. The impact on fluoroelastomer seals is relatively small for a 2 TBN increase, with very little change in the tensile strength and a moderate impact on rupture elongation.

There is a negative impact on L-85-99 antioxidancy testing by switching to the naphthylamine only, but a positive impact on PDSC. Nitration levels were decreased upon switching to naphthylamine only, as well as TBN retention (both D2896 and D4739).

The results suggest that the combination of the N-alkyl naphthylamine with the ashless antioxidant has a beneficial effect on the basicity of the composition without negatively impacting seals performance.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

The singular forms "a," "an," and "the" include plural referents unless the context clearly dictates otherwise.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon. Hydrocarbylene groups are the bivalent equivalents of hydrocarbyl groups, i.e., are attached at each end to two parts of the remainder of the molecule.

Examples of hydrocarbyl groups include:

(i) hydrocarbon substituents, that is, aliphatic (e.g., alkyl or alkenyl), alicyclic (e.g., cycloalkyl, cycloalkenyl) substituents, aryl, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups useful as hydrocarbyl groups may include at least 1, or at least 2, or at least 3, or at least 4 carbon atoms, and in some embodiments, up to 8, or up to 10, or up to 12, or up to 14, or up to 16, or up to 18 carbon atoms. Illustrative examples include methyl, ethyl, propyl, butyl, pentyl, hexyl, heptyl, octyl, 2-ethylhexyl, nonyl, decyl, undecyl, dodecyl, tridecyl, tetradecyl, hexadecyl, stearyl, icosyl, docosyl, tetracosyl, 2-butyloctyl, 2-butyldecyl, 2-hexyloctyl, 2-hexydecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, 4-methyl-2-pentyl, 2-propylheptyl, monomethyl branched-isostearyl, isomers thereof, mixtures thereof, and the like.

Representative alkenyl groups useful as hydrocarbyl groups include $C_2$-$C_{18}$ alkenyl groups, such as ethynyl, 2-propenyl, 1-methylene ethyl, 2-butenyl, 3-butenyl, pentenyl, hexenyl, heptenyl, octenyl, 2-ethylhexenyl, nonenyl, decenyl, undecenyl, dodecenyl, tridecenyl, tetradecenyl, hexadecenyl, isomers thereof, mixtures thereof, and the like.

Representative alicyclic groups useful as hydrocarbyl groups include cyclobutyl, cyclopentyl, and cyclohexyl groups.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, benzylphenyl, styrenated phenyl, p-cumylphenyl, α-naphthyl, β-naphthyl groups, and mixtures thereof.

Representative heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Numerical values in the specification and claims of this application should be understood to include numerical values which are the same when reduced to the same number of significant figures and numerical values which differ from the stated value by less than the experimental error of conventional measurement technique of the type described in the present application to determine the value.

As used herein, the term "comprising" is inclusive and does not exclude additional, un-recited elements or method steps. However, in each recitation of "comprising" herein, it is intended that the term also encompasses, as alternative embodiments, the phrases "consisting essentially of" and "consisting of," where "consisting of" excludes any element or steps not specified and "consisting essentially of" permits the inclusion of additional un-recited elements or steps that do not materially affect the basic and novel, and essential characteristics of the composition or method under consideration.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricating composition comprising:

an oil of lubricating viscosity, at least one ashless antioxidant, and an N-alkyl naphthylamine compound represented by the formula:

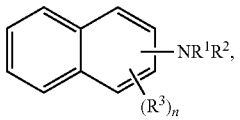

where $R^1$ is hydrogen, $R^2$ is an alkyl group of 1 to 30 carbon atoms, $R^3$ is an alkyl group of 1 to 30 carbon atoms, and n is from 0-2;

a ratio of the at least one ashless antioxidant to the N-alkyl naphthylamine compound present in the lubricating composition being from 40:60 to 80:20, and wherein the lubricating composition has a phosphorus content of less than 0.15 weight percent.

2. The lubricating composition of claim 1, wherein $R^2$ is alkyl group of 1 to 24 carbon atoms.

3. The lubricating composition of claim 1, wherein $R^2$ is alkyl group of at least 3 carbon atoms.

4. The lubricating composition of claim 1, wherein the N-alkyl naphthylamine is represented by the formula:

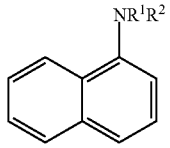

5. The lubricating composition of claim 1, wherein the N-alkyl naphthylamine is represented by the formula:

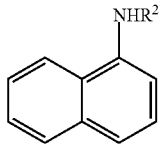

wherein $R^2$ is an alkyl group of 6 to 24 carbon atoms.

6. The lubricating composition of claim 1, wherein the at least one ashless antioxidant is present is present in a total amount of at least 0.15 weight percent of the composition.

7. The lubricating composition of claim 1, wherein the at least one ashless antioxidant comprises a diarylamine antioxidant.

8. The lubricating composition of claim 7, wherein the diarylamine antioxidant is selected from phenylnaphthylamines of the general formula:

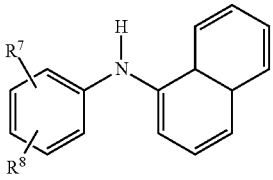

where each of $R^7$, $R^8$ is selected from H and $C_8$-$C_{24}$ alkyl groups and at least one of $R^7$ and $R^8$ is not H; and alkylated diphenylamine antioxidant of the general formula:

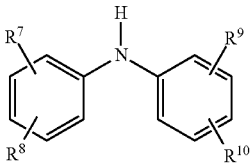

where each of $R^7$, $R^8$, $R^9$ and $R^{10}$, is selected from H and $C_8$-$C_{24}$ alkyl groups, and wherein at least one of $R^7$, $R^8$, $R^9$, and $R^{10}$ is not H.

9. The lubricating composition of claim 1, wherein the ashless antioxidant comprises a phenolic antioxidant.

10. The lubricating composition of claim 9, wherein the phenolic antioxidant is selected from the group consisting of $C_7$-$C_9$ branched alkyl esters of 3,5-bis(1,1-dimethyl-ethyl)-4-hydroxy-benzenepropanoic acid, 2-tert-butylphenol, 2-tert-butyl-4-methylphenol, 2-tert-butyl-5-methylphenol, 2,4-di-tert-butylphenol, 2,4-dimethyl-6-tert-butylphenol, 2-tert-butyl-4-methoxyphenol, 3-tert-butyl-4-methoxyphenol, 2,5-di-tert-butylhydroquinone, 2,6-di-tert-butyl-4-alkylphenols, 2,6-di-tert-butyl-4-alkoxyphenols, 3,5-di-tert-butyl-4-hydroxybenzylmercaptooctylacetate, alkyl-3-(3, 5-di-tert-butyl-4-hydroxyphenyl)propionates, 2,6-di-tert-butyl-a-dimethylamino-p-cresol, 2,2'-methylene-bis(4-alkyl-6-tert-butylphenol), bisphenols, polyphenols, p-t-butylphenol-formaldehyde condensates and p-t-butylphenol-acetaldehyde condensates.

11. The lubricating composition of claim 1, further comprising an antiwear agent.

12. The lubricating composition of claim 1, wherein the oil of lubricating viscosity is at least 40 weight percent of the lubricating composition.

13. A method of lubricating a mechanical device comprising supplying the lubricating composition of claim 1 to the device.

14. The lubricating composition of claim 1, wherein the N-alkyl naphthylamine is present in an amount of at least 0.15 weight percent of the lubricating composition.

15. The lubricating composition of claim 1, where in the N-alkyl naphthylamine is present in an amount of no more than 2.5 weight percent of the lubricating composition.

16. The lubricating composition of claim 1, wherein the at least one ashless antioxidant is present in a total amount of no more than 5 weight percent of the composition.

17. The lubricating composition of claim 1, further comprising an alkaline earth metal overbased detergent in an amount to deliver a total base number (TBN), as measured by ASTM D2896, of at least 2 mg KOH/g to the composition.

18. A method for improving the retention of total base number in a crankcase lubricating composition comprising an oil of lubricating viscosity, the method comprising:

incorporating an N-alkyl naphthylamine and at least one ashless antioxidant in the lubricating composition, the N-alkyl naphthylamine compound being represented by the formula:

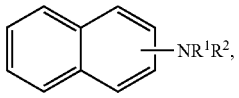

where $R^1$ is hydrogen, $R^2$ is an alkyl group of 1 to 30 carbon atoms, $R^3$ is an alkyl group of 1 to 30 carbon atoms, and n is from 0-2;

whereby a ratio of the at least one ashless antioxidant to the N-alkyl naphthylamine compound present in the lubricating composition is from 40:60 to 80:20, and the lubricating composition has a phosphorus content of less than 0.15 weight percent.

* * * * *